US011198269B2

(12) United States Patent
Totani

(10) Patent No.: US 11,198,269 B2
(45) Date of Patent: Dec. 14, 2021

(54) PLASTIC BAG MAKING APPARATUS

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 27 days.

(21) Appl. No.: 16/606,630

(22) PCT Filed: Apr. 5, 2018

(86) PCT No.: PCT/JP2018/014549
§ 371 (c)(1),
(2) Date: Oct. 18, 2019

(87) PCT Pub. No.: WO2018/193862
PCT Pub. Date: Oct. 25, 2018

(65) Prior Publication Data

US 2020/0130315 A1 Apr. 30, 2020

(30) Foreign Application Priority Data

Apr. 19, 2017 (JP) ..... JP2017-083070

(51) Int. Cl.
*B31B 70/00* (2017.01)
*B31B 70/20* (2017.01)
(Continued)

(52) U.S. Cl.
CPC ..... *B31B 70/006* (2017.08); *B31B 70/20* (2017.08); *B31B 70/74* (2017.08); *B31B 2150/00* (2017.08)

(58) Field of Classification Search
CPC ..... B31B 70/006; B31B 70/14; B31B 70/148; B31B 70/20; B31B 70/74; B31B 2150/00; B26D 7/18
(Continued)

(56) References Cited

U.S. PATENT DOCUMENTS 3,599,538 A * 8/1971 Piazze ..... B29C 65/18 493/194
5,478,302 A * 12/1995 Bluemle ..... B65D 31/08 493/235
(Continued)

FOREIGN PATENT DOCUMENTS

JP H03197124 A 8/1991
JP 11-190608 A 7/1999
(Continued)

OTHER PUBLICATIONS

International Search Report dated Jun. 26, 2018 by the International Searching Authority (Japan Patent Office) in PCT Application PCT/JP2018/014549.

*Primary Examiner* — Valentin Neacsu
*Assistant Examiner* — Jacob A Smith
(74) *Attorney, Agent, or Firm* — NovoTechIP International PLLC

(57) ABSTRACT

According to an apparatus for successively making the plastic bags, wherein the wastes 14 are formed in at least two areas adjacent to each other widthwise of the plastic film 1, and the apparatus can determine whether all of wastes 14 of each of the areas are discharged.

The apparatus comprises at least one partition plate 20 in a suction path 16. The suction path 16 is divided into at least two widthwise of the plastic film 1. The wastes 14 is guided to each of the divided paths 21A, 21B, 21C, 21D and is discharged. The wastes 14 is detected by an optical sensor when the wastes 14 is discharged to each of the divided paths.

16 Claims, 5 Drawing Sheets

(51) Int. Cl.
*B31B 70/74* (2017.01)
*B31B 150/00* (2017.01)

(58) Field of Classification Search
USPC ..... 493/1; 83/133, 142, 461, 620
See application file for complete search history.

(56) References Cited

U.S. PATENT DOCUMENTS 5,492,041 A * 2/1996 Valkanov ..... B26F 1/18 83/133
5,522,512 A * 6/1996 Archer ..... B65B 57/14 209/580
6,744,515 B1 * 6/2004 Totani ..... B26D 5/007 356/429
2005/0276525 A1 * 12/2005 Hebert ..... B65D 75/5833 383/203
2009/0133362 A1 * 5/2009 Bentele ..... B65B 57/12 53/54
2012/0135845 A1 * 5/2012 Totani ..... B26D 7/18 493/189
2013/0203574 A1 * 8/2013 Cao ..... B65B 5/022 493/17
2017/0036368 A1 * 2/2017 Ohnishi ..... B26D 7/1854
2018/0065765 A1 * 3/2018 Koike ..... B65B 51/10
2019/0077533 A1 * 3/2019 Hellenbrand ..... B65B 57/04

FOREIGN PATENT DOCUMENTS

JP H11190608 A * 7/1999 ..... B31B 1/02
JP 2003-326616 A 11/2003
JP 2003326616 A * 11/2003 ..... B31B 29/20
JP 2009-125835 A 6/2009
JP 2009125835 A * 6/2009 ..... B26D 7/18
JP 2015-054361 A 3/2015
JP 2015054361 A * 9/2015 ..... B26D 7/18

* cited by examiner

[Fig. 1]
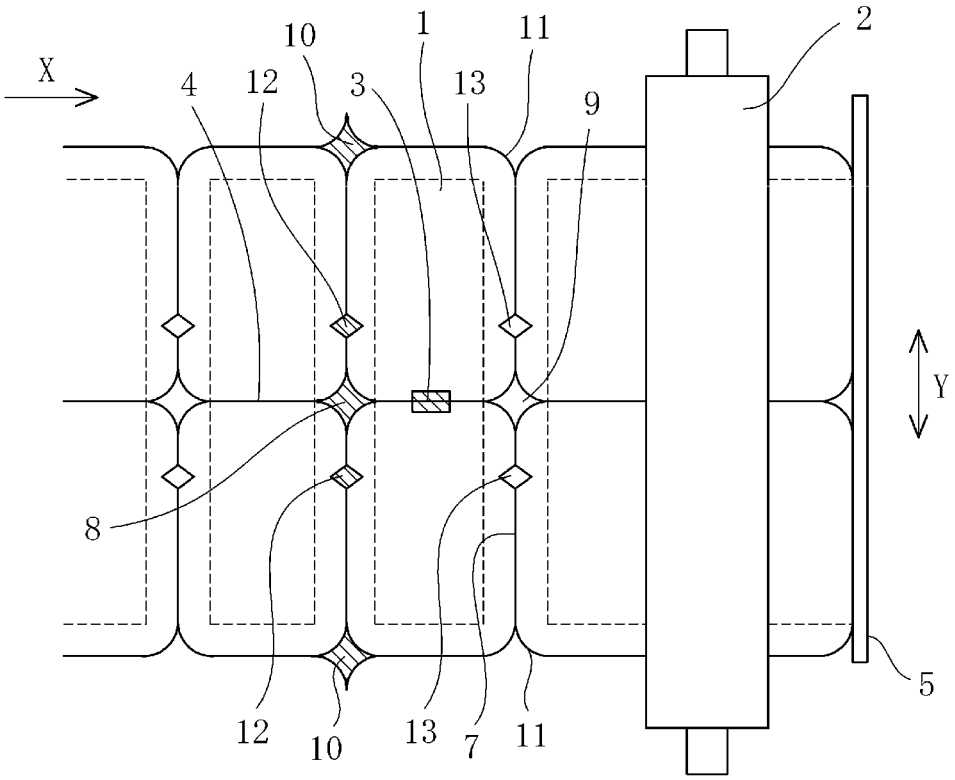

[Fig. 2]
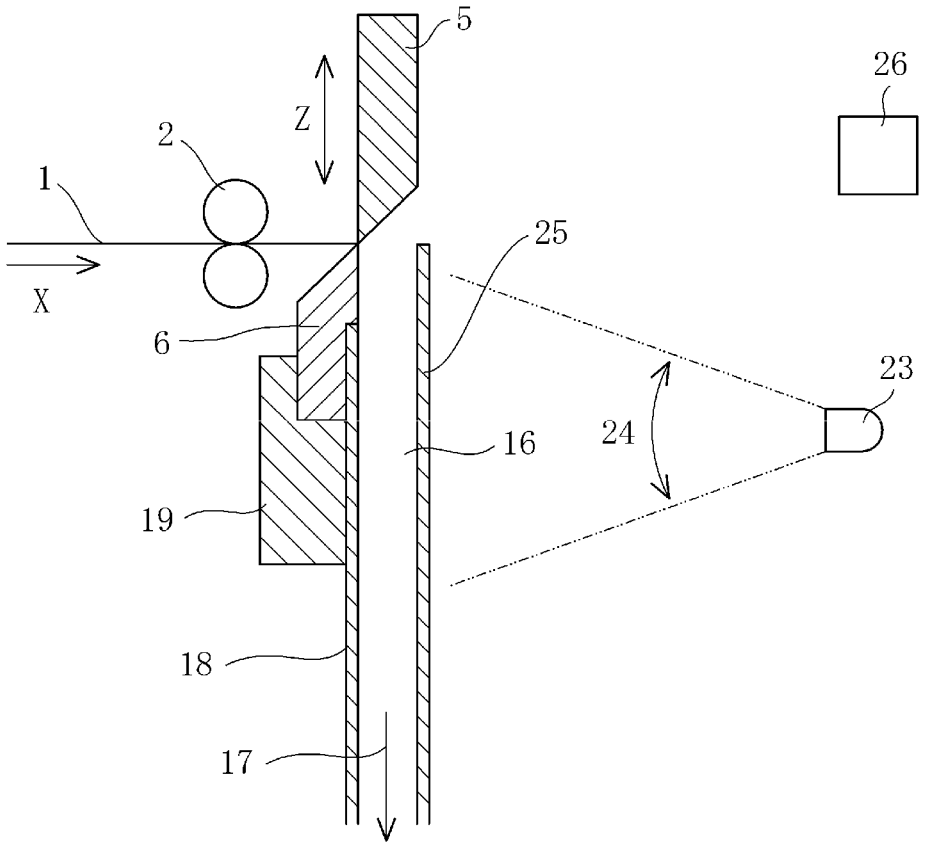
[Fig. 3]
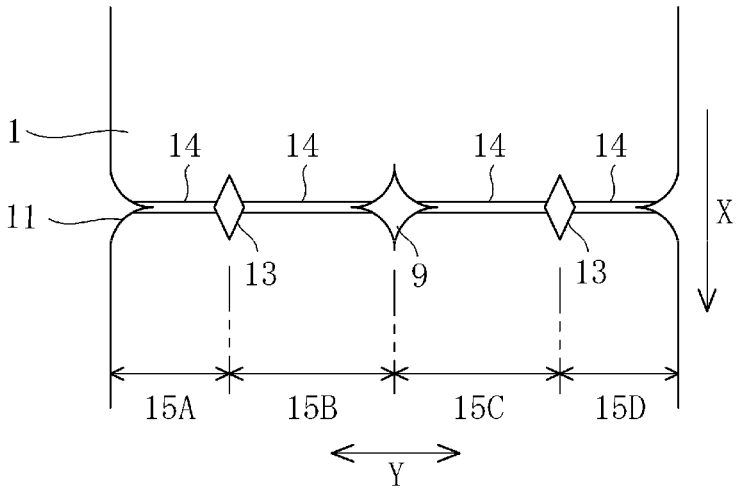

[Fig. 4]
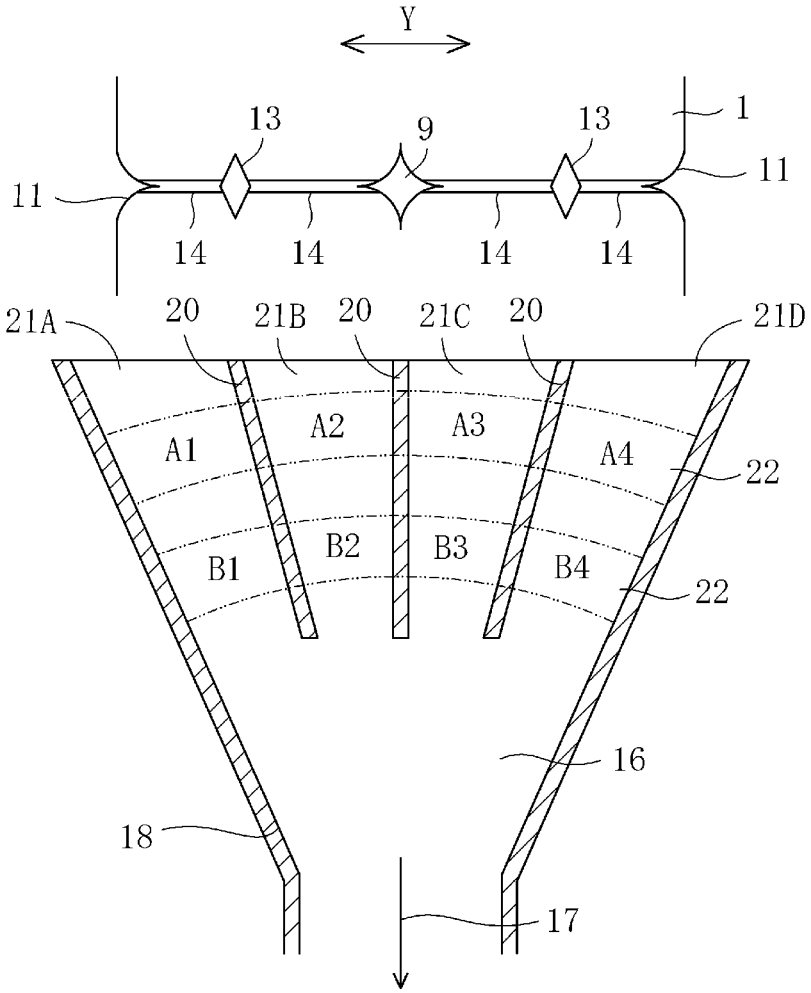

[Fig. 5]
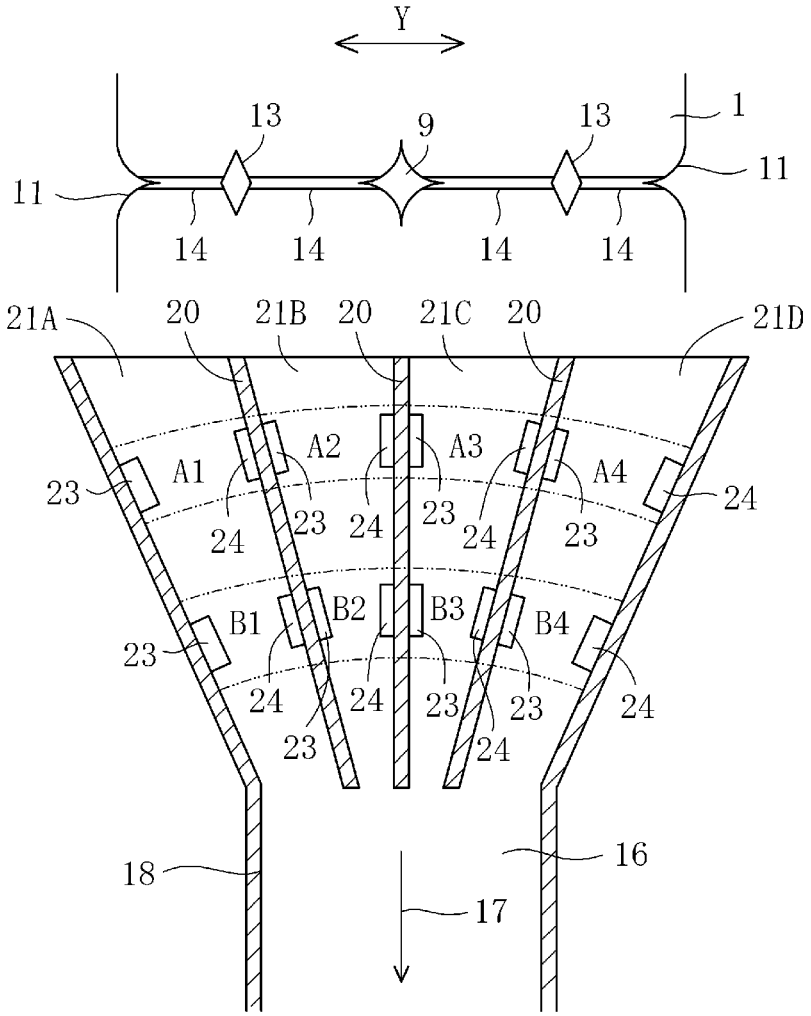

[Fig. 6]
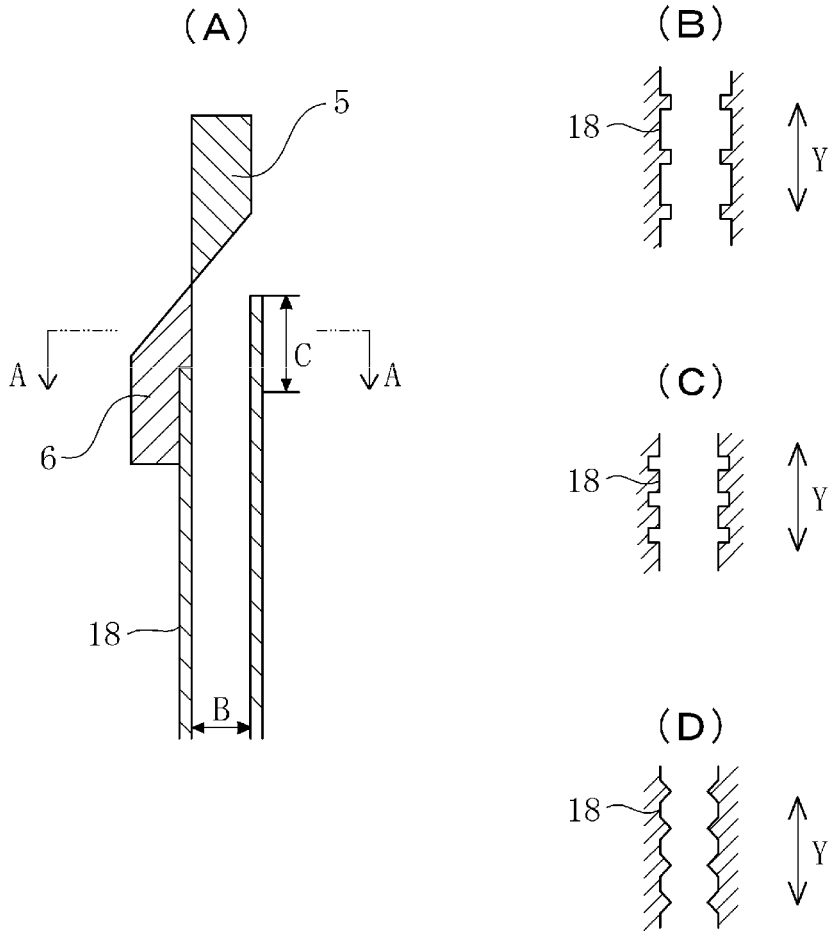

PLASTIC BAG MAKING APPARATUS

TECHNICAL FIELD OF THE INVENTION

The invention relates to an apparatus for successively making plastic bags.

BACKGROUND OF THE INVENTION

In an apparatus for successively making plastic bags from plastic films, some wastes are often formed while the plastic bag is made, as described in Patent Document 1. In the case of the apparatus of Patent Document 1, the wastes are suctioned in and discharged from a suction path. The apparatus comprises an optical sensor for detecting the wastes when being suctioned. When the waste is not discharged from the suction path, an action such as an alarm is performed by a controller. Therefore, there is no case that an undischarged waste is attached to the plastic film and fed intermittently. As a result, there is no problem of the waste being introduced into the plastic bag.

On the other hand, in an apparatus described in Patent Document 2, the plastic films are fed intermittently by feed rollers and slit along its longitudinal slit line. Then, the plastic films are cross cut by a cutter when stopped temporarily so as to make the plastic bags. In the apparatus, the plastic films are punched by punch blades when stopped temporarily so as to form corner cut areas in the plastic bags. Then, the plastic films are cross cut by the cutter two times whenever making each of the plastic bags. Therefore, the plastic films are cross cut at both sides across its widthwise cut line. As a result, any projected uneven edge is not formed at the corner cut area of the plastic bag.

By the way, in the apparatus of Patent Document 2, a plurality of wastes is formed in at least two areas adjacent to each other widthwise of the plastic bag because the plastic films are cross cut at the both sides across the widthwise cut line of the plastic bag after being slit and punched. In this case, as the apparatus of Patent Document 1, the wastes can be detected by the optical sensor after being suctioned in and discharged from a suction path. However, the apparatus cannot determine or examine whether all of wastes of each of areas are discharged even if the wastes are detected. Therefore, the undischarged waste may be attached to the plastic film and introduced into the plastic bag.

It is therefore an object of the invention to provide an apparatus for successively making the plastic bags, wherein the wastes are formed in at least two areas adjacent to each other widthwise of the plastic film, and the apparatus can determine whether all of wastes of each of the areas are discharged.

Patent Document 1: JP 2003-326616A
Patent Document 2: JP 2,805,515B

SUMMARY

According to the invention, an airflow is generated in a suction path so as to suction the waste of each of the areas. Further, at least one partition plate is disposed in the suction path in such a way that the suction path is divided widthwise of the plastic film into at least two. The waste is guided to each of the divided paths and is discharged. The waste is detected by an optical sensor when being discharged to each of the divided paths. A controller is connected with the optical sensor. An action such as an alarm is performed by the controller when the waste is not discharged to each of the divided paths.

According to another preferable embodiment, the waste is detected at more than two detect positions which are determined and spaced from each other in a direction of the airflow and in each of the divided paths.

Further, the controller determines that the waste is discharged when being detected at any one of the detect positions. Its detect level may be changed appropriately depending on the specification required for the plastic bag.

The optical sensor may be configured to detect that the wastes are generated in at least two areas, and be composed of, for example, a digital camera that converts an imaging information imaged on an image sensor thereof such as CCD into an electric signal. Concretely, the digital camera is opposed to the divided paths, a detect area of the digital camera includes each of the detect positions. An electronic shutter of the digital camera is actuated so as to detect the wastes when the wastes pass through each of the detect positions.

A pair of a projector and a receiver may be used as optical sensor.

A material with an antistatic property may be used for each wall of each of the divided paths preferably.

A high airtight material may be used for each wall of each of the divided paths preferably.

Each of the divided paths may have a smooth flow channel geometry preferably.

The partition plate may be configured to be moved widthwise of the plastic film preferably.

BRIEF DESCRIPTION OF THE DRAWING

FIG. 1 is a plan view of a preferred embodiment of the invention.

FIG. 2 is a side view of the apparatus of FIG. 1.

FIG. 3 is an explanatory view showing wastes of plastic films of FIG. 1.

FIG. 4 is a front view of a chute of FIG. 2.

FIG. 5 is a front view of the chute of FIG. 4 on which projectors and receivers are disposed as optical sensors.

FIG. 6A is a side view showing a relation between parts of FIG. 2 precisely.

FIGS. 6B to 6D are sectional views in a direction A of FIG. 6A.

DETAILED EXPLANATION OF THE PREFERRED EMBODIMENTS

Embodiments of the invention are as follows.

Turning now to the drawings, FIG. 1 illustrates an apparatus for successively making plastic bags.

In the apparatus, a plastic film 1 is nipped between a pair of feed rollers 2 after being heat sealed so as to be fed intermittently by the feed rollers 2. Its feed direction X is extended longitudinally of the plastic film 1. Then, the plastic film 1 is slit by a slit blade 3 at an upstream side of the feed rollers 2. The slit blade 3 is composed of a razor blade by which the plastic film 1 is slit along a longitudinal slit line 4. The longitudinal slit line 4 is the same as a center line of a longitudinal seal area of the plastic film 1.

Then, the plastic film 1 is cross cut by a cutter whenever the plastic film 1 is fed intermittently so as to make plastic bags. As shown in FIG. 2, the cutter is composed of a guillotine blade which includes an upper blade 5 and a lower blade 6. The upper blade 5 is lowered by a drive mechanism, so that the plastic film 1 is nipped between the upper and lower blades 5 and 6 by which the plastic film 1 is cross cut. Then, the upper blade 5 is elevated by the drive mechanism so as to be returned. Specifically, the upper blade 5 is moved in a vertical direction Z. The plastic film 1 is cross cut along its widthwise cut line 7.

At the upstream side of the feed rollers 2 and the slit blade 3, the plastic film 1 is punched by a punch blade 8 whenever the plastic film 1 is fed intermittently so as to form corner notches 9. The corner notch 9 is formed at an intersection of the longitudinal slit line 4 and the widthwise cut line 7. At the same time, the plastic film 1 is punched by punch blades 10 so as to form corner notches 11 in the plastic film 1. The corner notches 11 are formed at the widthwise cut line 7 and both side edges of the plastic film 1. Therefore, the plastic bag is corner cut by the corner notches 9 and 11 when the plastic film 1 is cross cut so as to make the plastic bag.

The plastic film 1 is punched by the punch blade 12 so as to form open notches 13 at the same time when the corner notches 9 and 11 are formed. The open notches 13 are formed at the widthwise cut line 7 and between each of the corner notches 9 and 11. Therefore, the plastic bag can be ripped from the open notch 13 so as to be opened.

Then, the plastic films are cross cut by the cutter two times whenever making each of the plastic bags. Therefore, the plastic films are cross cut at the both sides across the widthwise cut line 7 (FIG. 3). For example, similarly to the apparatus of Patent Document 2, the plastic film 1 is cross cut at the front side of the widthwise cut line 7, and then the upper and lower blades 5 and 6 are moved to the rear side of the widthwise cut line 7 so as to cross cut the plastic film 1 at the rear side of the widthwise cut line 7. And then, the upper and lower blades 5 and 6 are moved and returned to the front side of the widthwise cut line 7. In the same way, the widthwise cut line 7 is disposed at a position where top areas of the corner notches 9 and 11 and the open notches 13 can be connected with each other. The plastic film 1 is cross cut at the front and rear sides across the widthwise cut line 7. As a result, a projected uneven edge cannot be formed at the corner cut areas of the plastic bag.

In the apparatus, a plurality of wastes 14 is formed at more than two areas adjacent to each other widthwise Y of the plastic film 1 because the plastic film 1 is cross cut at the both sides across the widthwise cut line 7 of the plastic film 1 after being slit and punched. In this embodiment, the plastic film 1 is punched by the punch blades 8, 10 and 12 so as to form the corner notches 9 and 11 and the open notches 13. Therefore, the wastes 14 are formed at four areas 15A, 15B, 15C and 15D adjacent to each other widthwise Y of the plastic film 1 when the plastic film 1 is cross cut.

The open notches 13 are usually disposed near the upper side of the plastic bag (a pouch). However, in the case of FIGS. 3 to 5, the open notches 13 are disposed near the center of the plastic bag for convenience sake because the positions thereof are no relation with the spirit of the invention.

In the embodiment, as shown in FIG. 2, an airflow 17 is generated in a suction path 16 so as to suction the wastes 14 of the areas 15A, 15B, 15C and 15D. In the embodiment, the suction path 16 is formed in a hollow chute 18. The upper end of the chute 18 is opposed to the upper blade 5, while the lower end thereof is connected with a suction duct. The lower blade 6 is fixed to a base 19 which is fixed to the chute 18. Therefore, the chute 18 are moved integrally with the lower blade 6 when the upper and lower blades 5 and 6 are moved to the front and rear sides of the widthwise cut line 7. The suction path 16 is evacuated by the suction duct so as to generate the airflow 17 in the suction path 16. Thus, the waste 14 is suctioned in the suction path 16 so as to be discharged to the suction duct when the plastic film 1 is cross cut at the both sides across the widthwise cut line 7.

As shown in FIG. 4, the chute is fan-shaped. At least one partition plate 20 is disposed on the suction path 16 so as to divide the suction path 16 into at least two areas widthwise Y of the plastic film 1. The wastes 14 are guided and discharged to the divided paths. In the embodiment, a total of three of the partition plates 20 are disposed on the suction path 16 so as to divide the suction path 16 into four areas. The wastes 14 are guided and discharged to the divided paths 21A, 21B, 21C and 21D respectively. The partition plates 20 are extended along the suction path 16 and spaced from each other widthwise Y of the plastic film 1. The divided paths 21A, 21B, 21C and 21D have spaces corresponding to the areas 15A, 15B, 15C and 15D respectively (FIG. 3). Therefore, the wastes 14 of the areas 15A, 15B, 15C and 15D are reliably suctioned and discharged, respectively.

The wastes 14 are detected by an optical sensor when being discharged to the divided paths 21A, 21B, 21C and 21D respectively. In the embodiment, the wastes 14 are detected at more than two detect positions 22 and 22 which are determined and spaced from each other in a direction of the airflow 17 and in each of the divided paths 21A, 21B, 21C and 21D. For example, the wastes 14 are detected at two of the detect positions 22 and 22 which are determined and spaced from each other in a direction of the airflow 17.

As shown in FIG. 2, the optical sensor is composed of a digital camera 23 which can convert an imaging information imaged on an image sensor thereof such as CCD into an electric signal. The digital camera 23 is opposed toward the divided paths 21A, 21B, 21C and 21D. Its detect area 24 includes each of the detect positions 22. As shown in FIG. 4, the electronic shutter of the digital camera is actuated to detect the waste 14 when the waste 14 passes through the detect position 22. The number of the cameras 23 is determined depending on the specification of the camera 23. For example, in the case of FIG. 4, two cameras can be used as one is for the divided paths 21A and 21B and the other is for the divided paths 21C and 21D. Each of the cameras 23 is opposed toward the chute 18 and the divided paths 21A, 21B, 21C and 21D. The electric shutter of the digital camera 23 is actuated when the waste 14 passes through the detect position 22. The chute 18 is made of a clear glass or a clear plastic material in the detect area 24. The camera 23 can detect the waste 14 through the clear glass or the clear plastic material, which is disposed even on the outside of the chute 18.

The apparatus includes a controller 26 which is connected with the optical sensor. When the waste 14 is not discharged to the divided paths 21A, 21B, 21C and 21D, an action such as an alarm is performed by the controller 26. In the embodiment, the controller 26 determines that the waste 14 is discharged when the waste 14 is detected at one of two of the detect positions 22 and 22. For example, the controller 26 determines that the waste 14 is discharged when the waste 14 is detected at both of the two detect positions 22 and 22. In the same way, the controller 26 determines that the waste 14 is discharged when the waste 14 is detected at one of the two detect positions 22 and 22. Thus, the controller 26 determines that the waste 14 is not discharged when the waste 14 is not detected at both of the two detect positions 22 and 22. Therefore, the action such as the alarm is performed by the controller 26.

In the apparatus, the waste 14 is detected by the camera 23 when being discharged to the divided paths 21A, 21B, 21C and 21D. Therefore, the apparatus can determine whether or not all of the wastes 14 of the areas 15A, 15B, 15C and 15D are discharged. The action such as the alarm is performed when any one of the wastes 14 is not discharged to the divided paths 21A, 21B, 21C and 21D. Therefore, there is no chance that the undischarged waste 14 is attached to the plastic film 1 and introduced into the plastic bag.

The waste 14 may not be detected for some reason even if the waste 14 is discharged to the divided paths 21A, 21B, 21C and 21D. However, in the apparatus, the waste 14 can be detected at more than two of the detect positions 22 and 22. Therefore, the action such as the alarm is not performed by mistake because the waste 14 can be detected by the other detect position 22 even if the waste 14 cannot be detected by the particular detect position 22. Thus, the action such as the alarm is performed when the waste 14 is not detected at two of the detect positions 22 and 22 disposed at the upstream and downstream of the divided paths 21A. On the other hand, the action is not performed because the apparatus determines that the waste 14 is flowed through the divided paths 21A when the waste 14 is detected at either one of two of the detect positions 22 and 22.

As shown in FIG. 2, the camera 23 may be opposed to each of the divided paths 21A, 21B, 21C and 21D in such a way that the detect area 24 thereof can include each of the detect positions 22. In this way, the waste 14 can be efficiently detected by the common camera 23 in a low cost.

Such detection can be operated by a known signal processing technology. For example, the waste 14 can be detected by comparison between each of image data in a plurality of image areas before and after a predetermined time, the image data in the image areas are arbitrarily selected and memorized in a memory.

As a concrete structure, the camera 23 can for example image the whole of the fan-shaped part of the chute 18 of FIG. 4. At fast, the fan-shaped part of the chute 18 is imaged by the camera 23 before the waste 14 is suctioned in the chute 18, that is to say, before the plastic film 1 is cross cut by the upper and lower blades 5 and 6. The image data are memorized as data before cut. Then, the electronic shutter of the camera 23 is opened during a predetermined time from when the plastic film 1 is cross cut. The image data imaged by the camera during the time are memorized as data after cut. Then, the image data in the areas A1 to A4 and B1 to B4 of FIG. 4 are compared with each other by using the data before and after cut. When the data before and after cut of at least one of four pairs composed of the areas A1 and B1, the areas A2 and B2, the areas A3 and B3 and the areas A4 and B4 are the same respectively, the apparatus determines that the waste 14 is not passed through both the upstream side (the area A) and the downstream side (the area B). As a result, the alarm is raised and the apparatus is stopped before the cross cut is operated. For example, when the data before and after cut in the area A1 are the same respectively but the data in the area B1 are different respectively for some reasons, the waste 14 passed through the area A1 may not be detected for some error. However, the apparatus determines that the waste is passed through the path between the areas A1 and B1 and the alarm is not raised. This is defined as an algorithmic pattern 1.

The waste 14 can be kept from introducing into the plastic film 1 by operating the algorithmic pattern 1.

In the case that the introduction of a foreign matter is completely unacceptable, for example the pouch is made and used for medical purposes, the alarm is raised when the data before and after cut of any one of eight of the areas A1 to A4 and B1 to B4 are the same respectively by using stricter algorithm.

For example, in the case that the waste 14 generated at the time of the first cut is passed through the area A1 but attached to the inside wall of the chute 18 in front of the area B1, if the attached waste 14 is passed through the area B1 at the time of the second cut and detected, the apparatus determines that the waste 14 is passed through the path from the area A1 to the area B1 at the time of both the first and second cuts by using the algorithmic pattern 1. However, there is possible that the waste 14 remains attached and is not discharged at the time of the second cut. In this case, the alarm has to be raised by using another algorithmic pattern because the waste is not detected at the time of the first cut. This pattern is defined as an algorithmic pattern 2.

The algorithmic pattern 2 is operated, so that the introduction of the waste 14 can be prevented reliably.

The data before cut can be memorized before the waste 14 is generated. The word "predetermined time" may mean an enough time from when the cross cut is operated till when the waste 14 is suctioned in the chute 18 and arrived at the areas B1 to B4.

The apparatus can display the image through the camera 23 on an operation panel in such a way that the operator can select the image areas via the displayed image. For example, the operation panel is composed of a touch type operation panel, and the area A1 can be defined by touching the four corners of the partitioned area A1 by using a touch pen. Another area can be defined in the same way. Thus, the defined area can be changed even if the position of the partition plate 20 is changed in the chute 18. The camera 23 may be composed of any type of camera that can electrically convert the image into an image signal via an image sensor such as CCD, CMOD and FOVION sensor.

The airflow 17 is generated so as to suction the waste 14, however the waste 14 is attached to the inside of the chute 18 and is not discharged if the length thereof is so long. In this case, the waste 14 may be waved, so that the apparatus may determine that the waste 14 is passed through the detect positions 22 and 22 by mistake even though the waste 14 cut from the plastic film is not passed. However, the operator detects the waste 14 through the operation panel by viewing because the image through the camera 23 can be displayed on the operation panel. Then, the waste 14 can be forcibly discharged by cleaning the chute 18 physically.

Next, another embodiment including the sensors mounted on each of the areas A1 to A4 and B1 to B4 will be explained below with reference to FIG. 5.

FIG. 5 is a front view showing the chute 18 as viewed from the upstream side of the feed direction of the plastic film, similarly to FIG. 4. In the embodiment, the apparatus is configured to successively make the plastic bags one by one. Each pouch (plastic bag) has one notch, so that three of the partition plates 20 are disposed because the wastes 14 are generated at four positions. The partition plate 20 has the same depth as the chute 18 or as the dimension B shown in FIG. 6A.

The chute 18 includes projection portions on its inner surface side as shown in FIG. 6B so as to nip the partition plates to be positioned by the projection portions. The projection portions are preferably spaced from each other at a narrow pitch so as to change the position of the partition plates 20 of FIGS. 4 and 5. It is enough that the projection portions are disposed in the range of the dimension C shown in FIG. 6A. The position of the partition plate 20 can be changed widthwise Y of the plastic film depending on where the partition plate 20 is nipped between the projection portions.

As shown in FIG. 6D, in stead of the above projection portions, mountain shaped projection portions may be disposed and spaced from each other at a narrow pitch, and the partition plates 20 may have V shaped grooves corresponded to them. Thus, the position of the partition plate 20 can be changed in the same way.

As shown in FIG. 6C, grooves may be disposed in the inner surface of the chute 18 in such a way that the partition plate can be nipped between the grooves so as to be positioned. The grooves may be disposed in a direction normal to the feed direction of the plastic film and along the fun shape of the chute 18 radially so as to be extended to the end of the partition plate shown in FIG. 5. Therefore, the partition plates can be set at predetermined positions only by putting the partition plates into the grooves optionally.

As shown in FIG. 6A, even if the width of the plastic film is smaller than the width of the chute 18, the thickness of the upper blade 5 is the same as dimension B, and the width of the upper blade 5 is the same as the width of the chute 18. Thus, the open portions having a dimension B generated when cross cutting and disposed on the both sides of the plastic film can be covered by the upper blade 5. Therefore, the suction air does not leak at the both sides of the chute 18 so that the efficiency of the suction cannot be lowered when cross cutting.

As shown in FIG. 5, a plurality of pairs of projectors 23 and receivers 24 as optical sensors are disposed between the partition plates 20 and in the areas A1 to A4 and B1 to B4 respectively. The operation of each of the sensors is started at the same time when the upper blade 5 shown in FIG. 6A is moved, and the pairs of the projectors 23 and the receivers 24 detect the waste 14 passing between them in the areas A and B during the suction. The timing of the operation of the sensor is the same as the timing of the open of the above-described electronic shutter of the camera. The apparatus determines that the waste 14 is not passed through the path when any one of the four paired projectors 23 and the receivers 24 does not detect the waste 14, in which each of the four pairs is disposed in each of the four areas A1 and B1, A2 and B2, A3 and B3 and A4 and B4. Then, the alarm is worked and the apparatus is stopped until the cross cut starts. On the other hand, the apparatus determines that the waste 14 is passed through the path and the alarm is not raised when the waste 14 is detected by the sensor of either of the areas A and B.

Even in this case, the algorithmic pattern 2 may be operated when a stricter detection is needed as above described, and the apparatus may determine that the waste 14 is passed through the path only if the waste 14 is detected by the sensor of the both areas A and B.

The sensor may be composed of a fiber sensor so as to detect the waste 14 having a size at least about 2 mm by 10 mm by 0.1 mm minimum.

A material with an antistatic property may be preferably used for the walls of the divided paths 21A, 21B, 21C and 21D. For example, a metallic material, or a plastic material with a conductive property into which a carbon black is kneaded may be preferably used.

Further, an airtight material may be preferably used for the walls of the divided paths 21A, 21B, 21C and 21D. For example, the airtight thereof can be improved in a way that a main material is composed of metal, and a conductive rubber is used at the connected portion of the suction chute 18. The position of the conductive rubber is disposed below the position of the projection portion in such a way that the waste 14 cannot be engaged with the rubber as much as possible.

Each of the divided paths 21A, 21B, 21C and 21D has a smooth flow channel geometry preferably. For example, the wall surface is extended linearly, and the width of each of the wall surface and the groove becomes narrower from the upside to the downside so that the partition plate can easily be inserted and removed from the upside so as to be moved between the grooves.

The partition plate 20 can preferably be moved widthwise Y of the plastic film 1. The mechanism is not limited to the above structure of FIGS. 6B to 6D.

DESCRIPTION OF REFERENCE NUMBERS

1 plastic film
14 waste
15A, 15B, 15C, 15D area
16 suction path
17 airflow
20 partition plate
21A, 21B, 21C, 21D divided path
22 detect position
23 CCD camera
24 detect area
26 controller

What is claimed is:

1. An apparatus for successively making plastic bags from a plastic film, the apparatus including at least two areas where wastes may be formed, the areas being adjacent to one another widthwise of the plastic film, the apparatus comprising:

a suction path configured to support an airflow, wherein the wastes in the at least two areas can be suctioned by the airflow;

at least one partition plate configured to divide the suction path widthwise of the plastic film into at least two divided paths and to be moved in a widthwise direction relative to the plastic film, the partition plate being disposed in the suction path, the wastes being guided to each of the divided paths and being discharged;

an optical sensor configured to detect the wastes discharged to each of the divided paths; and a controller configured to perform an action when the wastes are not discharged to each of the divided paths, the controller being connected with the optical sensor.

2. The apparatus as set forth in claim 1, further comprising:

at least two detect positions disposed in each of the divided paths and spaced from each other in a direction of the airflow, wherein the wastes are detected at the at least two detect positions.

3. The apparatus as set forth in claim 2, wherein the controller determines that the wastes are discharged when the wastes are detected at any one of the at least two detect positions.

4. The apparatus as set forth in claim 3, wherein:

the optical sensor includes a digital camera that converts imaging information imaged on an image sensor into an electric signal, the digital camera is opposed to the divided paths, a detect area of the digital camera includes each of the detect positions, and an electronic shutter of the digital camera is configured to be actuated so as to detect the wastes when the wastes pass through each of the detect positions.

5. The apparatus as set forth in claim 1, wherein a wall of at least one of the divided paths includes a material with an antistatic property.

6. The apparatus as set forth in claim 1, wherein the divided paths are configured to seal the suction path from leaks.

7. The apparatus as set forth in claim 1, wherein each of the divided paths has a smooth flow channel geometry.

8. The apparatus as set forth in claim 1, wherein the action is an alarm.

9. An apparatus for successively making plastic bags by feeding a plastic film longitudinally and cutting the plastic film widthwise, the apparatus comprising:

a suction path configured to suction a plurality of strip wastes formed when the plastic film is cut widthwise; and suction means configured to generate an airflow in the suction path for suctioning the plurality of strip wastes, wherein:

the suction path is divided into a plurality of divided paths by at least one partition plate along the airflow in such a way that the plurality of strip wastes is guided to the plurality of divided paths, the partition plate being configured to be moved in a widthwise direction relative to the plastic film, and the apparatus comprises:

an optical sensor configured to detect a waste of the plurality of strip wastes, the optical sensor being disposed in the plurality of divided paths; and a controller configured to receive an output of the optical sensor, wherein the controller performs an action when detecting that a waste is not discharged to the plurality of divided paths based on the output of the optical sensor.

10. The apparatus as set forth in claim 9, wherein the action is an alarm.

11. The apparatus as set forth in claim 9, wherein the optical sensor is configured to detect a waste at two detect positions spaced from one another in a direction of the airflow.

12. The apparatus as set forth in claim 11, wherein the controller determines that the detected waste is discharged when the detected waste is detected at any one of the two detect positions.

13. The apparatus as set forth in claim 9, wherein the optical sensor includes a digital camera that converts imaging information imaged on an image sensor into an electric signal, wherein the digital camera is opposed to the plurality of divided paths and the digital camera includes an electronic shutter configured to be actuated so as to detect a waste of the plurality of strip wastes as the waste passes through the plurality of divided paths.

14. The apparatus as set forth in claim 9, wherein a wall of at least one of the divided paths includes a material with an antistatic property.

15. The apparatus as set forth in claim 9, wherein the divided paths are configured to seal the suction path from leaks.

16. The apparatus as set forth in claim 9, wherein each of the divided paths has a smooth flow channel geometry.

* * * * *